US007290372B2

(12) United States Patent
Aust et al.

(10) Patent No.: US 7,290,372 B2
(45) Date of Patent: Nov. 6, 2007

(54) EXPANDABLE CONTAINER

(75) Inventors: Ingo Aust, Uhldingen-Muehlhofen (DE); Heiner Koch, Bermatingen (DE)

(73) Assignee: EADS Deutschland GmbH, Ottobrunn (DE)

( * ) Notice: Subject to any disclaimer, the term of this patent is extended or adjusted under 35 U.S.C. 154(b) by 739 days.

(21) Appl. No.: 10/697,262

(22) Filed: Oct. 31, 2003

(65) Prior Publication Data

US 2005/0072062 A1 Apr. 7, 2005

(30) Foreign Application Priority Data

Sep. 24, 2003 (DE) ..... 103 44 180

(51) Int. Cl.
*E04B 7/16* (2006.01)

(52) U.S. Cl. ..... 52/67; 52/66; 52/79.1; 52/79.5

(58) Field of Classification Search ..... 52/67, 52/66, 79.5, 79.1, 143; 296/26.01, 26.09, 296/26.13, 165, 171, 173, 175
See application file for complete search history.

(56) References Cited

U.S. PATENT DOCUMENTS 2,765,499 A * 10/1956 Couse ..... 52/66
2,920,920 A * 1/1960 Couse et al. ..... 296/26.02
3,106,750 A * 10/1963 Lee ..... 52/67
3,429,608 A * 2/1969 Farnum ..... 296/173
5,265,394 A * 11/1993 Gardner ..... 52/640
5,577,351 A 11/1996 Dewald, Jr. et al.
5,765,316 A * 6/1998 Kavarsky ..... 52/67

FOREIGN PATENT DOCUMENTS

| | | | |
|---|---|---|---|
| DE | 4429927 | A1 | 11/1995 |
| DE | 10135226 | A1 | 2/2003 |
| EP | 0760040 | B1 | 1/1999 |
| EP | 0682 156 | B1 | 3/2000 |
| EP | 1251207 | A2 | 10/2002 |

* cited by examiner

*Primary Examiner*—Basil Katcheves
(74) *Attorney, Agent, or Firm*—Crowell & Moring LLP

(57) ABSTRACT

A container, especially intended for use as a workroom, with an adjustable volume includes a base container with a floor panel and a roof panel, and at least one box-shaped expansion element that can be extended from the base container. The expansion element includes a floor panel, a roof panel, a side that is open to the base container, a front panel that is opposite the open side, and two side panels. The container further includes a device with which a box-shaped expansion element can be lowered, such that, once the expansion element has been extended, the floor panels of the expansion element and the base container are at the same height, and with which an expansion element can be raised such that, once the expansion element has been lowered, it can be reinserted into the base container. The roof panel of the box-shaped expansion element is designed to fold along a horizontal axis on the upper edge of the front panel of the expansion element.

21 Claims, 5 Drawing Sheets

20
52
50
28
29
25
1

27
26
20
33
28
29
55
50
25
54
2
1
19
17
18
15
16
10 a)

b)

c)

EXPANDABLE CONTAINER

This application claims the priority of German application 103 44 180.8, filed Sep. 24, 2003, the entire disclosure of which is hereby incorporated by reference into the present application.

BACKGROUND AND SUMMARY OF THE INVENTION

The present invention relates to an expandable container, especially for use as a workroom, with a adjustable vole.

One container of this type is known, e.g., from European publication EP 0 682 156 B1. That container comprises a base container and one or more expansion elements for expanding the made space, which can be drawn out or extended from the container. The expansion elements are box-shaped and closed on all sides—with the exception of the open side that faces the bass container. In order to achieve a flat floor inside the container when the expansion elements are extended, a lowering or hoisting device is provided, with which the expansion elements can be lowered such that, after they have been lowered, the floors of the base container and the expansion element(s) are at the same height.

The gaps in the base container that are created by the extension and lowering (due to the panel thicknesses of the floor and roof elements of the expansion elements) must be closed off by means of flaps and suitable seals, Long seals create problems in terms of the use of expandable containers, especially when requirements for ABC seal tightness and HF shielding are involved.

In embodiments in which two expansion elements are used, the dimensions of the two expansion elements must be selected to maximize the floor space of the workroom such that one expansion element can be inserted into the other expansion element. Since, for logistical reasons (i.e. truck transport, air transport capability) the containers ordinarily may not significantly eyed a height of 8' (2,440 mm), the headroom (inside height), especially in the smaller of the two expansion elements, is relatively low (ca. 190 cm or less). In workrooms that are to be used by people standing upright, or in which people will be moving about a great deal, this is considered too low.

It is thus an object of the invention to improve upon an expandable container of the type described above such that the headroom (inside height) in the working area and the traffic area is improved without negatively altering the advantageous properties of these containers.

This object is attained by way of an adjustable volume container including a base container with a floor panel and a roof panel, and a box-shaped expansion element that can be extended from the base container, and which includes a floor panel, a roof panel, an open side that is open to the base container, a front panel that is opposite the open side, and two side panels. The container also has a device with which the box-shaped expansion element can be lowered such that, once the expansion element has been extended, the floor panel of the expansion element and the base container are at the same height, and with which the expansion element can be Fed such that, once the expansion element has been lowered, it can be reverted into the base container. The roof panel of the box-shaped expansion element is designed such that it can be folded along a horizontal axis on an upper edge of the front panel of the expansion element. Advantageous embodiments of the invention are the object of further claim.

According to the invention, the roof panel of a box-shaped expansion element is designed such that it can be folded about a horizontal alas on the upper edge of the front panel of the expansion element. When the expansion element has been extended, the roof panel can be folded upward along this axis and fastened to the base container. This results in an enlarged inside height in the main working and traffic areas of the container, so that concentrated work and movement are enabled without special restrictions, even for tall adults.

Advantageously, supplementary surface elements are provided, with which the gaps or holes between the side panels and the roof panel of a box-shaped expansion element that are created by the folding up of the roof panel can be closed off. In this manner, an inside space that is completely sealed off from the outside is created. As will be shown in detail below, this space can be easily sealed so that requirements for ABC seal tightness and HF shielding can be properly fulfilled, To this end, the folding roof panels are attached via sealing elements to the adjacent surface elements of the container.

A process of enlarging main working and traffic areas of a container is also claimed.

The following advantages in particular are associated with the invention:

Expanded headroom (inside height);

Simple sealing, short sealing elements;

Improved runoff of rain and snow on the outer roof surfaces of the expansion elements;

Improved cleaning and clearing of the outer roof surfaces of the expansion elements.

These advantages of the invention are disclosed in the follow description of a concrete exemplary embodiment, with reference to the drawings.

DETAILED DESCRIPTION OF THE INVENTION

Figure 1:
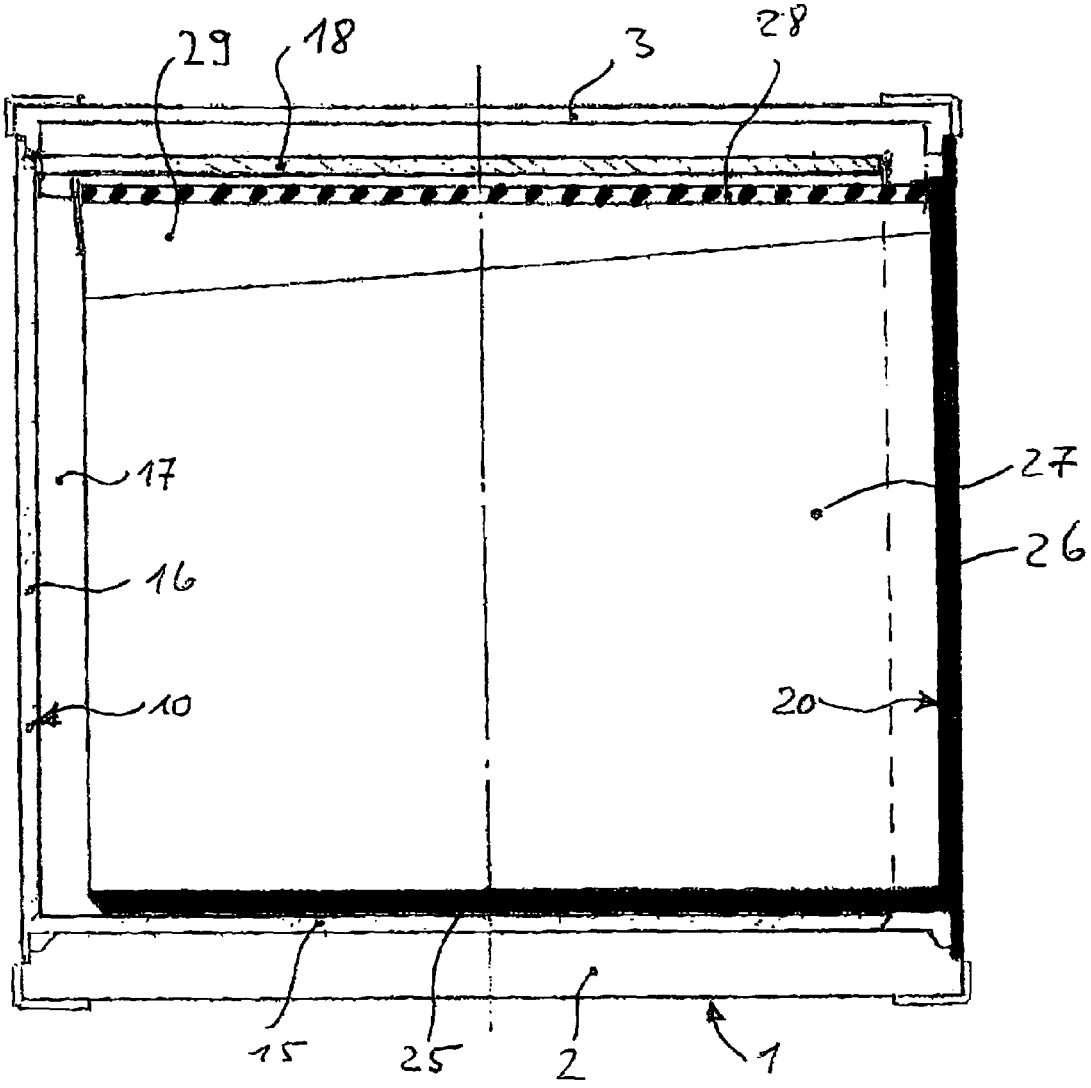
FIG. 1 is a vertical cross-section of a container according to the invention with unextended expansion elements.

FIGS. 1 through 4 show the individual steps in the assembly of an expandable container as specified in the invention, with two expansion elements. In FIG. 1, the initial stage (transport stage) is represented. The box-shaped base container 1 contains the two expansion elements 10, 20, also box-shaped The expansion element 20 is stowed inside the somewhat larger (in terms of length and height) expansion element 10. Also recognizable in this drawing are the respective bas panels 15, 25 and front panels 16, 26 of the two expansion elements 10, 20, along with their side panels 17, 27, Each of the roof panels 18, 28 of the expansion elements is seated displaceably (hinge 99) above at the front panels 16, 26, and, in the initial stage (transport stage), are positioned and fastened horizontally. The base container 1 has a base panel 2 and a roof panel 3.

Figure 2:
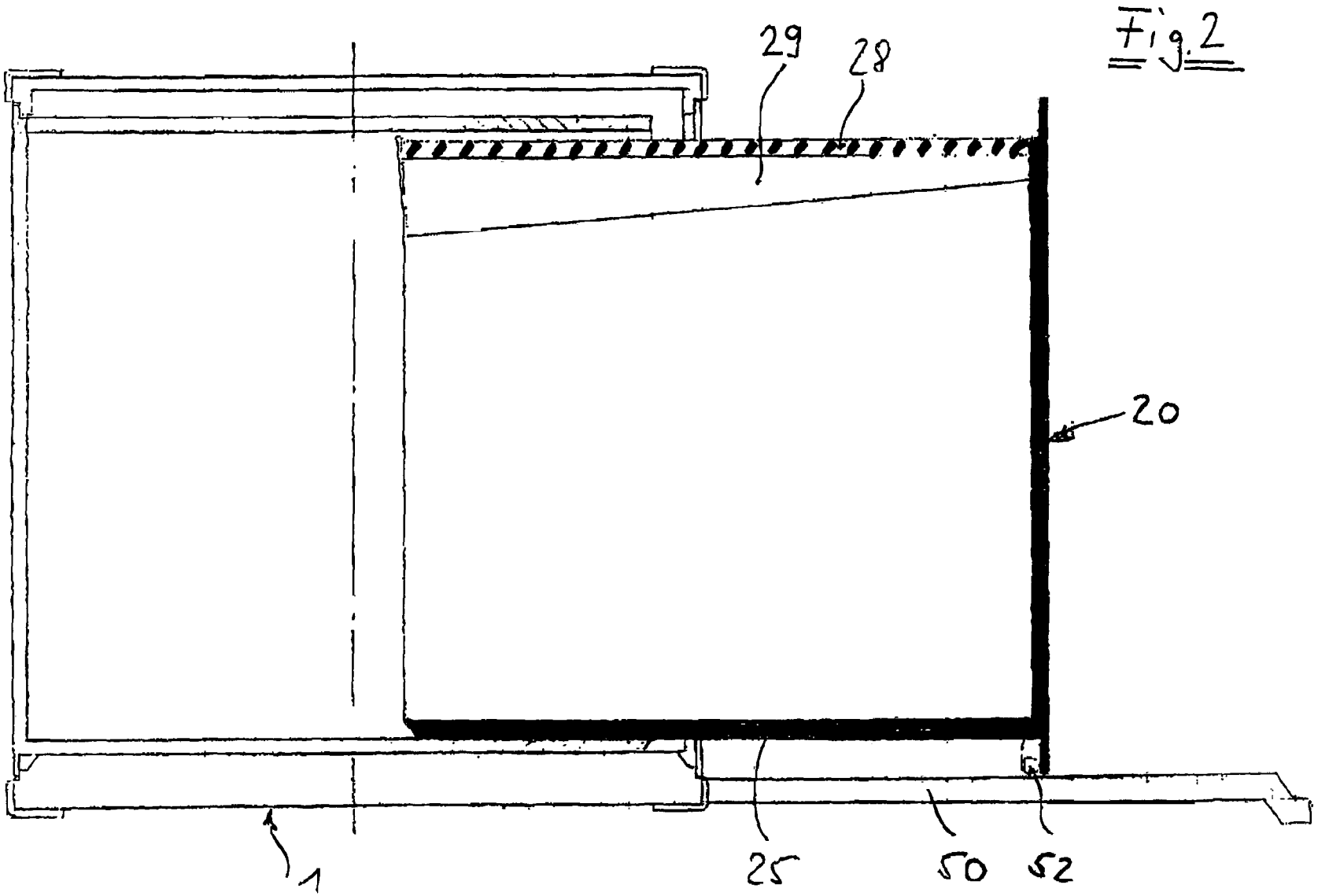
FIG. 2 is a vertical cross-section of a container according to the invention with a partially extended first expansion element.

In FIG. 2, the smaller expansion element 20 has already been partially extended. Typically, guide rails 50, which can also be extended from the base container 1, are used to extend the elements. The expansion element 20 is moved horizontally by means of rollers 52, which roll along the guide rails 50. The length of the mount, to the underside of which the rollers 52 are attached, is dimensioned such that the base panel 25 of the expansion element will remain horizontal during the extension process. The roof element 28 remains horizontal during the extension process.

Figure 3:
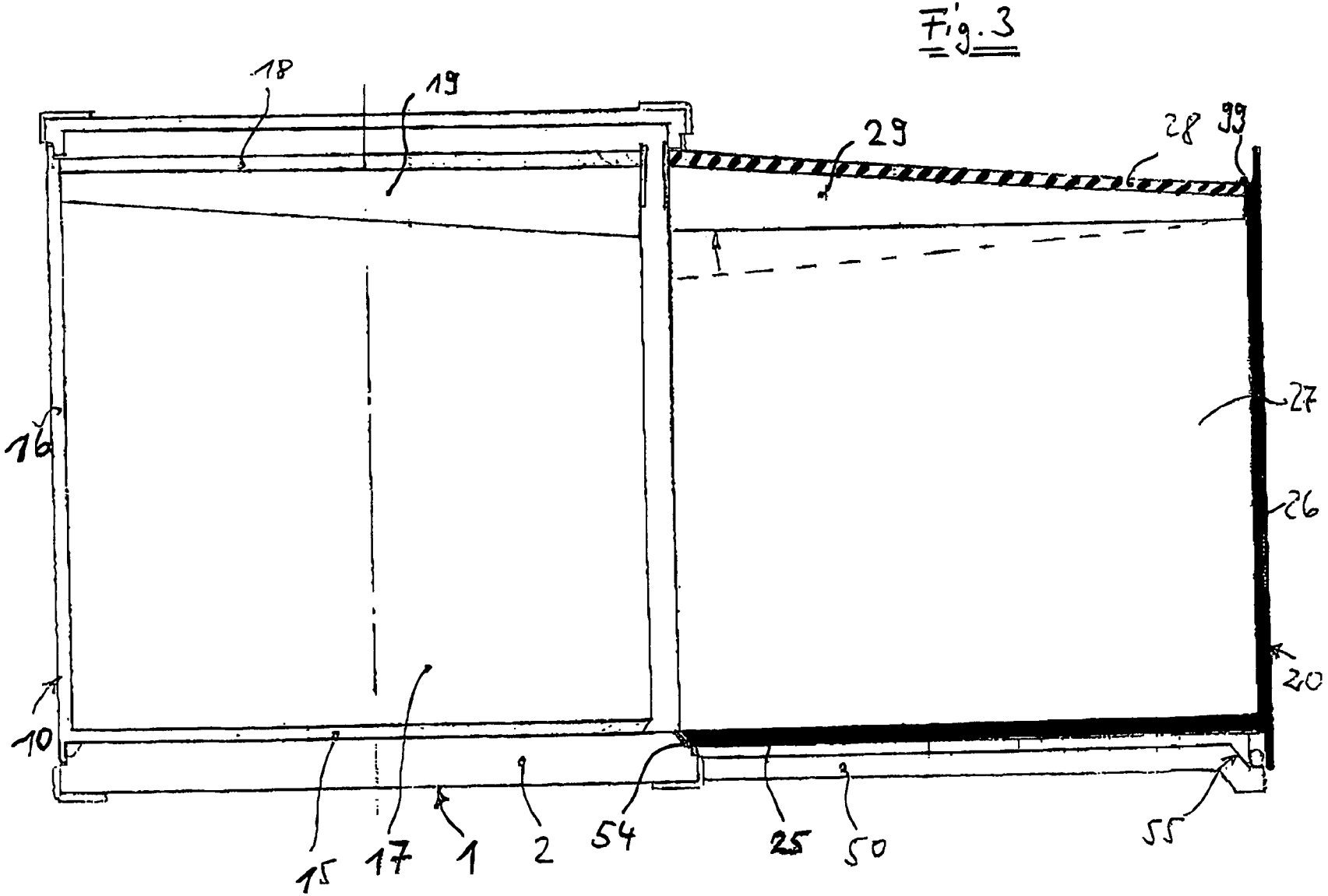
FIG. 3 is a vertical cross-section of a container according to the invention with a fully extended and lowered first expansion element.

In FIG. 3, the smaller expansion element 20 has been completely extended and then, once it has reached the end of the guide rails 50, has been lowered (angled steps 54 and 55 at the end of the rail 50 or at the base panel 2 of the base container 1, as is known, e.g., from European Publication EP 0 682 156 B1), so that now the base panel 25 of the expansion element 20 is at the same height as the base panel 2 of the base container 1. The roof elements 16, 28 are raised around the his of rotation 99 on the upper edge of the front panel 16, 26, and are interlocked with the base container 1. For improved handling, the roof elements can be relieved by means of lifting devices or by spring-loaded elements that compensate for the dead weight.

It is noted that various embodiments of mechanisms for lowering an expansion element em known to those skilled in the art. As an alternative to the lowering of the expansion elements by means of angled steps 55 shown here, the guide rails, for example, can also be designed as lift rails (see, e.g., European publication EP 0 760 040 B1). To this end the guide rail is divided into two parallel partial rails positioned one above the other, wherein the one peal rail i be rued and lowered relative to the other, e.g. by means of a hydraulic cylinder.

Figures 4, 5A, 5B:
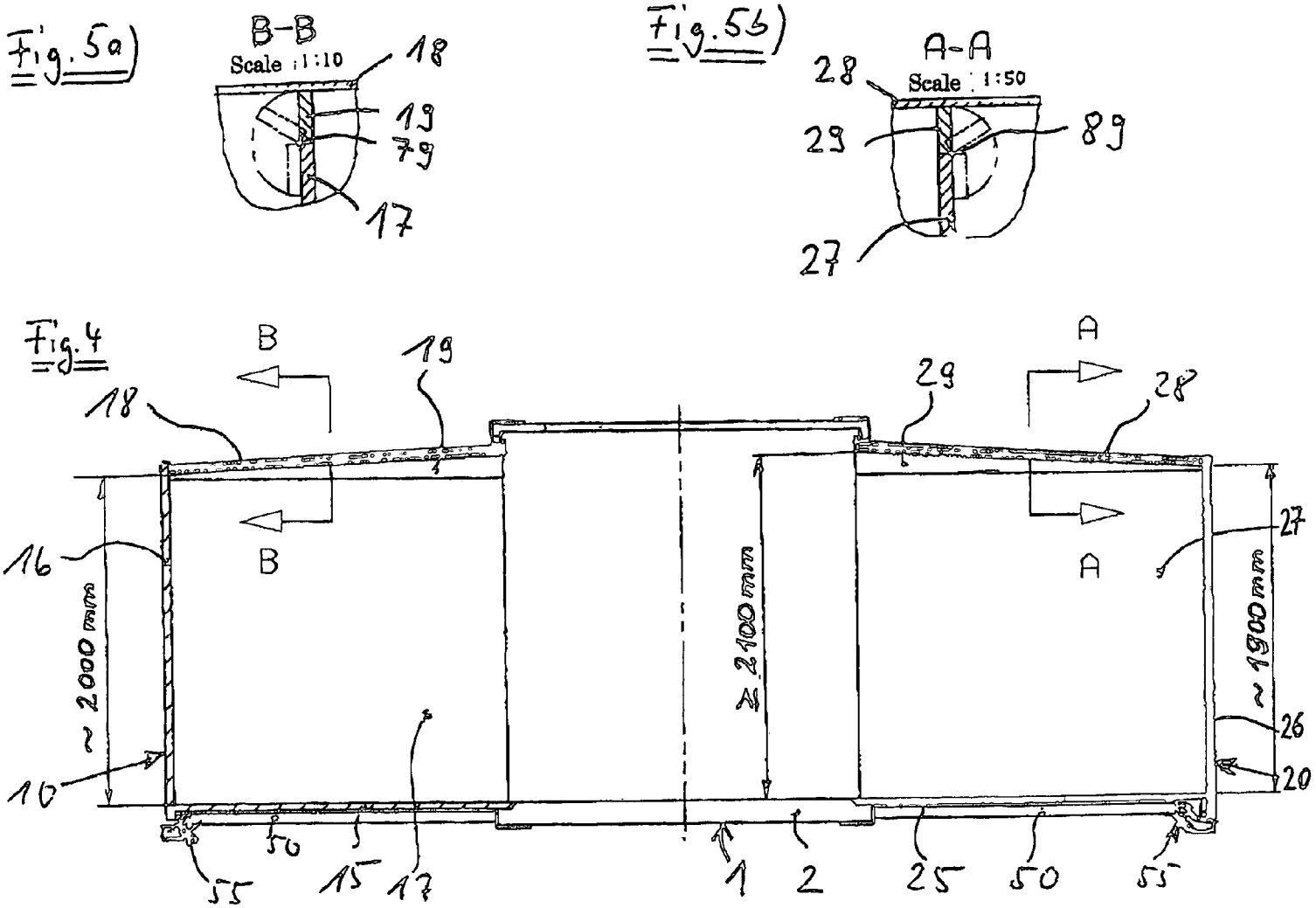
FIG. 4 is a vertical cross-section with two fully extended and lowered expansion elements.
FIGS. 5*a* and 5*b* are vertical cross-sections along the lines A-A and B-B in FIG. 4, respectively, illustrating the supplementary surface elements designed to seal the container along the roof panel of an expansion element.

FIG. 4 shows the situation in which both expansion elements 10, 20 have been fully extended and lowers. Examples of dimensions for the minimum headroom in containers that are 20' high (outside) in the two expansion elements are indicated for each When the expansion elements 10, 20 are lowered, the folding roof panels 18, 28 that form the roof of the expansion elements 10, 20 end up at a downward slope toward the outside. In this, in principle, the slope of the smaller expansion element 20 is somewhat greater. Thus it is ensured especially that rainwater will be directed away from the seals at the junction between the base container and the expansion element.

The sectional drawings in FIGS. 5*a* and 5*b*, which show views along the lines A-A and B-B in FIG. 4, illustrate in detail the supplementary surface elements 19, 29 (in this embodiment desired to be trapezoidal) that are arranged perpendicular to the roof elements or panels 18, 29. With these, the open to the side panels 17, 27, formed when the roof elements 18, 28 are folded up, are closed off. In the embodiment shown in FIGS. 5*a* and 5*b*, the supplementary surface elements 19, 29 are designed to be foldable. They can be rotated around a horizontal s of rotation 79, 89 on the upper edge of a side seduce 17, 27, and are locked against the front panels 16, 26 and the roof panels 18, 28 via friction seals.

The roof panels 18, 28 can be sealed towards the base container 1 by a movable friction seal (not shown here). The joint area between the front 17 and the roof panels; 18, 28 can also be permanently sealed along the tact length by means of a permanently mounted seal made of flexible material.

Figure 6:
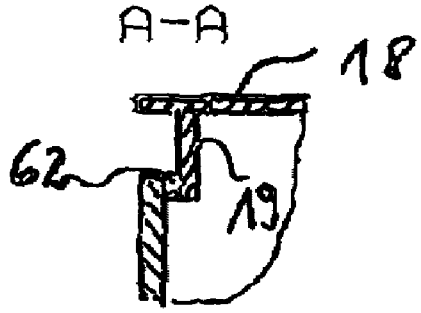
FIGS. 6*a*-6*c* show alternative exemplary embodiments for the supplementary surface elements and for the sealing of the container along the roof panel of an expansion element (sections along the lines A-A and B-B in FIG. 4).
Figure 6:
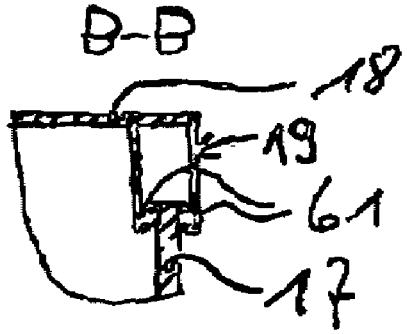
Figure 6:
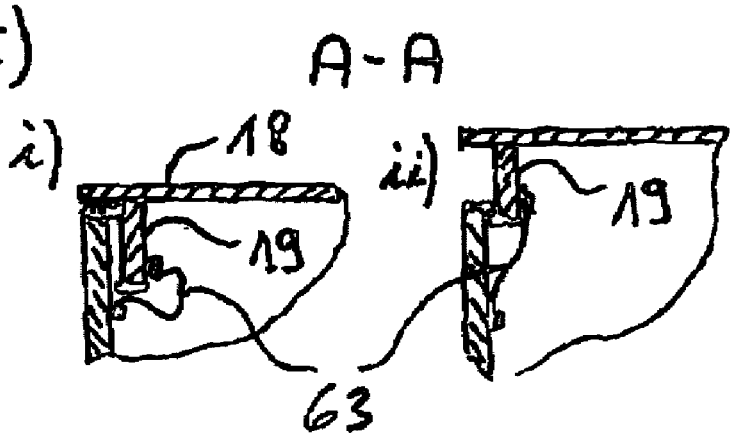

FIGS. 6*a*-6*c* show alternative exemplary embodiment for the supplementary surface elements and their seals. Each of these is a sectional view lines A-A and B-B in FIG. 4. In these embodiments, the supplementary surface elements are permanently attached to the roof panels 18, 28. They can be to be single-shell (FIG. 6*a*) or dual-shell (FIG. 6*b*).

The seals between the side panels 17, 27 and the surface elements that are permanently attached to the roof elements 18, 28 can be created using brush friction seals 61, 62.

Alternatively, permanently attached seals 63 made of flexible material ed tight when folded up, forming a fold in the lowered state/transport state) used, as is shown in FIGS. 6*ci* and 6*cii*. A sealing cushion may also be used.

The examples represented in the drawings all show embodiments having exactly two expansion elements. Of course, embodiments having one or more expansion elements are also possible. The extension process ad tie lowering process would then be analogous to the sequences for the individual expansion elements 10, 20.

The foregoing disclosure has been set forth merely to illustrate the invention and is not intended to be limiting. Since modifications of the disclosed embodiments incorporating the spirit and substance of the invention may occur to persons skilled in the art, he invention should be construed to include everything within the scope of the appended claims and equivalents thereof.

We claim:

1. A container with adjustable volume, comprising:

a base container with a floor panel and a roof panel, a box-shaped expansion element that can be extended from the base container, and which includes a floor panel, a front panel, and two side panels in permanently fixed positions relative to each other, an open side opposite the front panel, and a roof panel, and a device with which the box-shaped expansion element can be lowered such that, during expansion, the floor panel remains horizontal and such that, once the expansion element has been extended, the floor panel of the expansion element and the base container are at the same height, and with which the expansion element can be raised such that, once the expansion element has been lowered, it can be reinserted into the base container, wherein the roof panel of the box-shaped expansion element is designed such that it can be folded along a horizontal axis on an upper edge of the front panel of the expansion element.

2. The container according to claim 1, wherein the box-shaped expansion element is one of precisely two box-shaped expansion elements that can be extended in opposite directions out of the base container, and wherein the dimensions of the expansion elements are selected such that one expansion element can be inserted into the other expansion element.

3. The container according to claim 1, wherein the roof panel is attached by sealing elements to form a seal against adjacent surface elements of the container.

4. The container according to claim 1, and further comprising supplementary surface elements with which gaps between the side panels and the roof panel of the box-shaped expansion element, formed when the roof panel is folded up, can be closed off so that an inside space that is completely closed off from the outside is formed.

5. The container according to claim 4, wherein the supplementary surface elements are arranged such that they can be folded along an upper edge of at least one of the side panels.

6. The container according to claim 5, wherein friction seals are provided as sealing elements between the supplementary surface elements and the roof panel or the front panel.

7. The container according to claim 6, wherein each of the supplementary surface elements is respectively disposed on one side of or on opposite sides of said at least one of the side panels.

8. The container according to claim 5, wherein each of the supplementary surface elements is respectively disposed on one side of or on opposite sides of said at least one of the side panels.

9. The container according to claim 4, wherein the supplementary surface elements are arranged rigidly on the roof panel.

10. The container according to claim 9, wherein brush seals or friction seals are provided as sealing elements between the supplementary surface elements and the side panels.

11. The container according to claim 10, wherein each of the supplementary surface elements is respectively disposed on one side of or on opposite sides of at least one of the side panels.

12. The container according to claim 9, wherein permanently attached seals made of a flexible material are used as sealing elements between the supplementary surface element and the side panels.

13. The container according to claim 12, wherein at least one the permanently attached seals is stretched tightly when the roof panel is folded up and forms a fold when the roof panel is folded down or is a sealing cushion.

14. The container according to claim 13, wherein each of the supplementary surface elements is respectively disposed on one side of or on opposite sides of at least one of the side panels.

15. The container according to claim 12, wherein each of the supplementary surface elements is respectively disposed on one side of or on opposite sides of at least one of the side panels.

16. The container according to claim 9, wherein each of the supplementary surface elements is respectively disposed on one side of or on opposite sides of at least one of the side panels.

17. The container according to claim 4, wherein each of the supplementary surface elements is respectively disposed on or on opposite sides of at least one of the side panels.

18. The container according to claim 1, wherein friction seals are provided as sealing elements between the roof panel and the base container.

19. The container according to claim 1, wherein permanently attached seals made of a flexible material are provided as sealing elements between the roof panel and the front panel.

20. The container according to claim 1, wherein the container is used as a workroom.

21. A process of enlarging main working and traffic areas of a container with adjustable volume comprising:

providing a base container with a floor panel and a roof panel, providing a box-shaped expansion element that can be extended from the base container and which includes a floor panel, a front panel, two side panels, all in permanently fixed positions relative to each other, as well as an open side opposite the front panel, and a roof panel, and providing a device with which the box-shaped expansion element can be lowered such that the floor panel remains horizontal once the expansion element has been extended, with the floor panels of the expansion element and the base container at the same height, and folding the roof panel of the box-shaped expansion element along a horizontal axis on an upper edge of the front panel of the expansion element so that the expansion element can be reinserted into the base container.

* * * * *